United States Patent [19]

Neil

[11] 4,206,500

[45] Jun. 3, 1980

[54] SELF CONTAINED ILLUMINATING DEVICE

[76] Inventor: Harry N. Neil, 22204 Avenue 318, Exeter, Calif. 93221

[21] Appl. No.: 906,335

[22] Filed: May 16, 1978

[51] Int. Cl.[2] ..... F21V 35/00

[52] U.S. Cl. ..... 362/161; 362/181; 362/182

[58] Field of Search ..... 362/161, 181, 182

[56] References Cited

U.S. PATENT DOCUMENTS

Re. 186,623 10/1932 Root ..... 362/161

*Primary Examiner*—Stephen J. Lechert, Jr.

*Attorney, Agent, or Firm*—Dennis B. Haase

[57] ABSTRACT

The present invention relates to improvements in self contained illuminating devices, generally of the type otherwise referred to as candles, but differing from ordinary candles in that a container is employed into which a combustible oil or a meltable, combustible substance, such as wax or tallow, is placed, such as by pouring the same in a melted state such that upon hardening, the material conforms to the shape of the container. In particular, the focus of the invention is on an improved flame sustaining wick device constructed primarily of a non-rigid, typically low combustibility material having a cellular structure which will permit a drawing action by the wick of the liquid oil or melted material up through the wick to the flame. The wick of the present invention includes an internally disposed stiffener including a base portion sufficient to support the wick within the container and in an essentially vertical free-standing attitude either in the presence of or in the absence of material and regardless of whether said material is in the liquid or solid state.

6 Claims, 3 Drawing Figures

SELF CONTAINED ILLUMINATING DEVICE

BACKGROUND OF THE INVENTION

The candle has been the source of illumination since the memory of man runneth not to the contrary. In the last decade, in addition to being a source of illumination, candles have become highly decorative, being molded and/or carved into a variety of shapes and sizes and in a myriad of colors and color combinations. The development of suitable flame sustaining devices has not paralleled the development of candles as a functional and decorative illuminating device, and have, through the ages, remained little more than pieces of string or rope, or at the most, some cotton waste formed into a make-shift flame supporting device. Indeed, many candles are typically manufactured by dipping wicks into molten wax or tallow material.

An energy shortage which became a reality in late 1973, coupled with a gradual but discernible metamorphosis in life style and living habits has placed the self contained illuminating devices such as candles in a new, significant and highly important role in the every day life of today's family. However, even the most modern such illuminating devices is fraught with drawbacks which inevitably dampen the enthusiasm otherwise generated by such devices. For example, wick materials of prior art devices tend to burn, curl and otherwise become limp, making them hard to light and in some instances brittle and easily breakable in a burned area, therefore making the candle unrelightable. If the illuminating device is contained, as in the present improved device, known wicks tend to shrivel, and because they are limp, can not stand upright in a pool of molten wax or tallow and as a result, may literally flop over into the molten material causing a fire, or at the very least, extinguishing the flame and defeating the purpose of the device entirely.

The problem emphasized here, and obviated by the present invention, has been recognized by past innovators going back at least into the 1940's. Alexiade U.S. Pat. No. 2,324,753, for example, espouses a stiffener device which surrounds the wick, but it likewise severely limits the area from which the wick can draw flammable fluid to burn. Those such as Roberts in his U.S. Pat. No. 2,818,718 and later, MacDonald in his U.S. Pat. No. 3,385,084 attempted to reinforce the wick by wrapping it, but these makeshift solutions likewise fall short in their efforts to render the self contained illuminating device such as a candle, a truly utilitarian device. Not until the advent of the present improved wick device has it been possible for the candle to achieve the degree of sophistication which will permit it to become a useful, as well as decorative, household necessity.

SUMMARY OF THE INVENTION

Briefly stated, it is the objective of the present invention to accomplish a substantial improvement in self-contained illuminating devices such as candles by providing a novel means which permits the wick to remain erect under all conditions, with or without wax or tallow being present and irrespective of the solid or liquid state of any such wax or tallow which is present. Moreover, the invention permits a maximum wick area to be contiguous with molten wax or tallow, thereby permitting optimum amount of absorption and delivery by capillary or other action to the flame source. The improved wick of the present invention is thus able to be lit and relit without the slightest difficulty for the entire period during which any oil, wax or tallow remains present within the container.

BRIEF DESCRIPTION OF THE DRAWINGS

Having thus summarized the invention, there is appended hereto a sheet of drawing wherein the preferred embodiment of the invention is illustrated and in that regard.

DESCRIPTION OF THE PREFERRED EMBODIMENT

Figure 1:
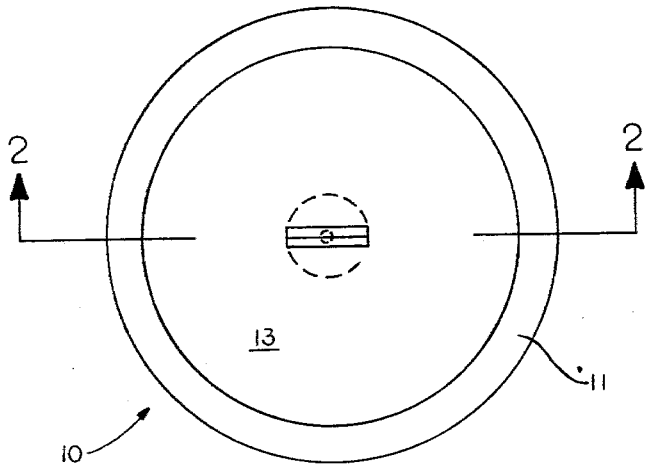
FIG. 1 is a top plan view of a preferred embodiment of the present invention, illustrating the interrelationship of wick, container, and meltable material.

Having thus described the state of the art and placed the present invention within the matrix of the as yet unsolved problems faced by manufacturers of self contained illuminating devices, the following is a detailed description of a preferred embodiment of the present invention which should be read in conjunction with the three figures of the drawing previously described.

With respect now to those drawings, and with particular emphasis on FIG. 1, there is shown an improved self contained illuminating device embodying the precepts of the present invention at 10. The device comprises a container 11 which may be of any suitable shape or size, and may be decorated to render it suitable to any number of motifs, decorative styles and tastes. For purposes of the present invention, a simple bowl-shaped container is provided into which an oil or meltable material such as wax or tallow may be placed. The wax material, of course, necessarily has a relatively low melting point and is preferrably smokeless when burned. Its viscosity in the melted state must be such that it is readily drawn through the wick to the flame source.

Figure 2:
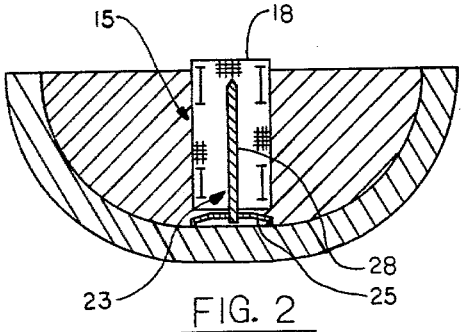
FIG. 2 is a side elevation of the device of FIG. 1 seen along section lines 2—2 of FIG. 1.

A flame sustaining wick device constructed in accordance with the present invention is best seen in FIG. 2 at 15, and in the illustrated case, is vertically disposed within the container and partially immersed within the meltable material 13. The wick comprises a relatively soft essentially nonflammable material, having a cellular structure such that it is capable of drawing melted material upwardly therethrough when the upper portion 18, which protrudes above the level of the material within the container is lighted and a flame is sustained.

Figure 3:
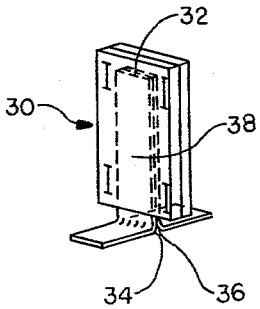
FIG. 3 is a pictorial representation of a modified form of a stiffening device falling within the umbra of the present invention.

An essential attribute of the present invention is the capacity of the wick to remain upright irrespective of the state of the material 13 or the quantity within the container at any given time. This is accomplished, in accordance with the invention, by providing a stiffener, one form of which is illustrated in FIG. 2 at 23. The stiffener, in the illustrated case, comprises a base portion 25 of sufficient size to render the wick free-standing by supporting the weight of the wick in the absence of meltable material 13. Extending upwardly from said base is a vertically disposed stiffener 28 which is completely imbedded within the wick material. The height of the stiffener will vary with the size and weight of the wick, but typically it will extend to within a few millimeters of the top of the wick, terminating at a point approximating the center of the sustained flame, which is not illustrated. With reference to FIG. 3, and comparing the same with FIG. 2, it will be seen that the specific shape of the wick, and thus the stiffener member, may vary in accordance with the need determined by the size of the wick.

It will be apparent that the size and shape of the flame can be dictated to a large extent by the size and shape of the wick. The present invention has utility irrespective of wick size and shape. For example, if a very broad wick is to be used, the modified form of the invention illustrated in FIG. 3 provides one solution. In that instance, there is shown a unitary strip of metallic material 30 which has been bent along seam 32 to form two essentially parallel and contiguous strips. Each of the strips is then bent along seams 34 and 36 respectively, to thereby form a colinear, essentially perpendicular base for the vertical member or stiffener 38, which material then surrounds the stiffener as previously described. Such a device not only provides vertical rigidity but also a certain amount of lateral and tortional rigidity which is highly desirable in illuminating devices. It will be evident, of course, that a strip of wick material may be readily folded and sealed about either of the stiffener devices illustrated to form the wick. It will be equally evident that such a wick will have veritcal as well as lateral stability irrespective of the state, i.e., solid or liquid, of the meltable material 13 or the level of that material in the container itself. Moreover, because a wick of substantial breadth is permitted with such devices having a substantial area contiguous with the meltable material, the wick is capable of supporting a substantial flame for increased illumination and, of course, is readily useable outdoors even in wind, rain or mist (fog) because of its stability and flame area.

The invention claimed is:

1. An illuminating device comprising, in combination a container a typically solid meltable material disposed in said container flame sustaining wick means comprising a relatively soft, essentially nonflammable material capable of drawing melted material upwardly therethrough when the upper portion is lighted, said wick means being vertically disposed within said container and partially immersed in said material stiffener means partially disposed within said wick, said stiffener consisting of a base portion adequate to support said wick independently of said material, and a rigid member projecting upwardly from said base and embedded in said wick means to thereby rigidify said wick sufficiently to hold the same upright during burning of said meltable material.

2. The illuminating device as set forth in claim 1 wherein said base member is supported on the bottom of said container.

3. The illuminating device as set forth in claim 1 wherein said rigid member comprises a pin projecting upwardly from said base portion and is wholly encircled by wick material.

4. The illuminating device as set forth in claim 2 wherein said rigid member comprises a pin projecting upwardly from said base portion and is wholly encircled by wick material.

5. The illuminating device as set forth in claim 2 wherein said rigid member has a width greater than its depth.

6. The illuminating device as set forth in claim 5 wherein said rigid member and base portion are integrally formed and said base portion comprises an extension of said rigid member disposed perpendicular thereto.

* * * * *